US007163373B2

(12) United States Patent
Liang

(10) Patent No.: US 7,163,373 B2
(45) Date of Patent: Jan. 16, 2007

(54) VORTEX DISSIPATION DEVICE FOR A COOLING SYSTEM WITHIN A TURBINE BLADE OF A TURBINE ENGINE

(75) Inventor: George Liang, Palm City, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 159 days.

(21) Appl. No.: 11/049,238

(22) Filed: Feb. 2, 2005

(65) Prior Publication Data

US 2006/0171808 A1 Aug. 3, 2006

(51) Int. Cl.
*F01D 5/18* (2006.01)

(52) U.S. Cl. ..... 416/97 R; 415/115

(58) Field of Classification Search ..... 415/115, 415/116, 96 R, 97 R
See application file for complete search history.

(56) References Cited

U.S. PATENT DOCUMENTS

| | | | | |
|---|---|---|---|---|
| 2,843,354 | A | 7/1958 | Smith | |
| 4,407,632 | A | 10/1983 | Liang | |
| 5,052,889 | A | 10/1991 | Abdel-Messeh | |
| 5,395,212 | A | 3/1995 | Anzai et al. | |
| 5,413,463 | A | 5/1995 | Chiu et al. | |
| 5,536,143 | A | 7/1996 | Jacala et al. | |
| 5,738,493 | A | 4/1998 | Lee et al. | |
| 5,902,093 | A | 5/1999 | Liotta et al. | |
| 5,993,156 | A | 11/1999 | Bailly et al. | |
| 6,132,174 | A | 10/2000 | Staub et al. | |
| 6,183,194 | B1 | 2/2001 | Cunha et al. | |
| 6,290,462 | B1 | 9/2001 | Ishiguro et al. | |
| 6,446,710 | B1 * | 9/2002 | Beeck et al. | 165/109.1 |
| 6,672,836 | B1 | 1/2004 | Merry | |

FOREIGN PATENT DOCUMENTS

| | | |
|---|---|---|
| JP | 09324604 | 12/1997 |

* cited by examiner

*Primary Examiner*—Edward K. Look
*Assistant Examiner*—Dwayne J White

(57) ABSTRACT

A turbine blade for a turbine engine having a cooling system in the turbine blade formed from at least one cooling channel. The cooling system may include one or more protrusions positioned in the cooling channel and including one or more vortex breakers along the length of the protrusion. The vortex breakers disrupt vortices formed downstream of the protrusions to increase heat transfer enhancement effect of the protrusions. The cooling channels of the cooling system may include a plurality of protrusions whose configuration is based upon the cooling requirements of the blade in which the cooling system is installed.

20 Claims, 3 Drawing Sheets

VORTEX DISSIPATION DEVICE FOR A COOLING SYSTEM WITHIN A TURBINE BLADE OF A TURBINE ENGINE

FIELD OF THE INVENTION

This invention is directed generally to turbine blades, and more particularly to the components of cooling systems located in hollow turbine blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion at one end and an elongated portion forming a blade that extends outwardly from a platform coupled to the root portion at an opposite end of the turbine blade. The blade is ordinarily composed of a tip opposite the root section, a leading edge, and a trailing edge. The inner aspects of most turbine blades typically contain an intricate maze of cooling channels forming a cooling system. The cooling channels in the blades receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade.

Cooling channels forming a cooling system in a turbine blade often include a plurality of trip strips protruding from the walls of the channels. As cooling air flows through the cooling channel, a boundary layer is formed. The trip strips create vortices in cooling air flowing through the channel thereby increasing the effectiveness of the cooling channels. The trip strips are generally aligned orthogonal to the air flow through the cooling channel. However, in some conventional cooling systems, the trip strips may be aligned at an angle to the flow of cooling air. As cooling air passes over the angled trip strips, vortices are created immediately downstream of the trip strip and move along the trip strip from an end furthest upstream toward the downstream end of the trip strip. As the vortices propagate along the length of the trip strip, the boundary layer becomes progressively more disturbed or thickened, and consequently the tripping of the boundary layer becomes progressively less effective. The net result of the thickening or growth of the boundary layer in significantly reduced heat transfer enhancement that is typically associated with thin vortices formed by trip strips. Thus, a need exists for a cooling channels capable of increasing the heat transfer enhancement action of the trip strips.

SUMMARY OF THE INVENTION

This invention relates to a turbine blade cooling system formed from at least one cooling channel containing a protrusion, otherwise referred to as a trip strip or turbulator, having a vortex breaker positioned on the protrusion for increasing the cooling capacity of the cooling channel. The cooling channel may be positioned in a generally elongated turbine blade having a leading edge, a trailing edge, a tip at a first end, and a root coupled to the blade at an end generally opposite the first end for supporting the blade and for coupling the blade to a disc. The turbine blade may include at least one cavity forming the cooling system in the turbine blade. Interior aspects of the cooling channel may include a protrusion positioned at an angle greater than zero relative to a general direction of cooling fluid flow through the cooling system. The vortex breaker may have a width and a height that is greater than a width of the protrusion. In at least one embodiment, the vortex breaker may be generally oval shaped.

The cooling channels forming the cooling system may include one or a plurality of protrusions along the length of the channels. The protrusions may be placed generally parallel to each other and nonparallel to the flow of cooling fluids through the cooling channels. In other embodiments, the protrusions may be nonparallel relative to each other. At least some, if not all, of the protrusions include one or more vortex breakers for disrupting the vortices formed downstream of the protrusions as the vortices flow from an intersection between the protrusion and a side wall forming the cooling channel along the protrusion. The vortex breakers extend higher than the protrusion but, in at least one embodiment, do not contact an inner surface of the cooling channel opposite the inner surface so as to not increase the resistance to cooling fluid flow.

During operation of a turbine engine, cooling fluids are passed through a cooling system. More specifically, cooling fluids are passed into cooling channels forming the cooling system. As the cooling fluids flow through the channels, the cooling fluids encounter at least one protrusion. As the cooling fluids encounter a protrusion, a vortex is formed proximate to a downstream side of the protrusion. The vortex moves generally along the protrusion from an intersection between the protrusion and a side wall forming the cooling channel. As the cooling air flows over a vortex beaker, a new boundary layer of cooling fluids is formed. The newly formed boundary layer created by the vortex breaker shears the vortices developed by the upstream portion of the protrusion. The shearing action caused by the vortex breaker causes the formation of an undisturbed boundary layer for the trailing edge portion of the protrusion. In this fashion, the vortex breaker has essentially created a second leading edge to the protrusion. The leading edge created by the vortex breaker generates a high heat transfer coefficient and corresponding improvement in overall cooling performance.

An advantage of this invention is that the vortex breaker increases the efficiency of the cooling system without significantly increasing the pressure or reducing the flow rate of cooling fluids through the system. Instead, the internal heat transfer enhancement level is increased due to the formation of a second leading edge and new boundary layer caused by the vortex breakers.

Another advantage of this invention is that multiple vortex breakers at variable angles of protrusions enable the cooling pattern of a cooling channel to be tailored to specific heat loads encountered in a different turbine blades.

Still another advantage of this invention is that this invention provides higher overall airfoil internal convective cooling enhancement with a reduction in cooling flow demand, which results in improved turbine engine performance.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
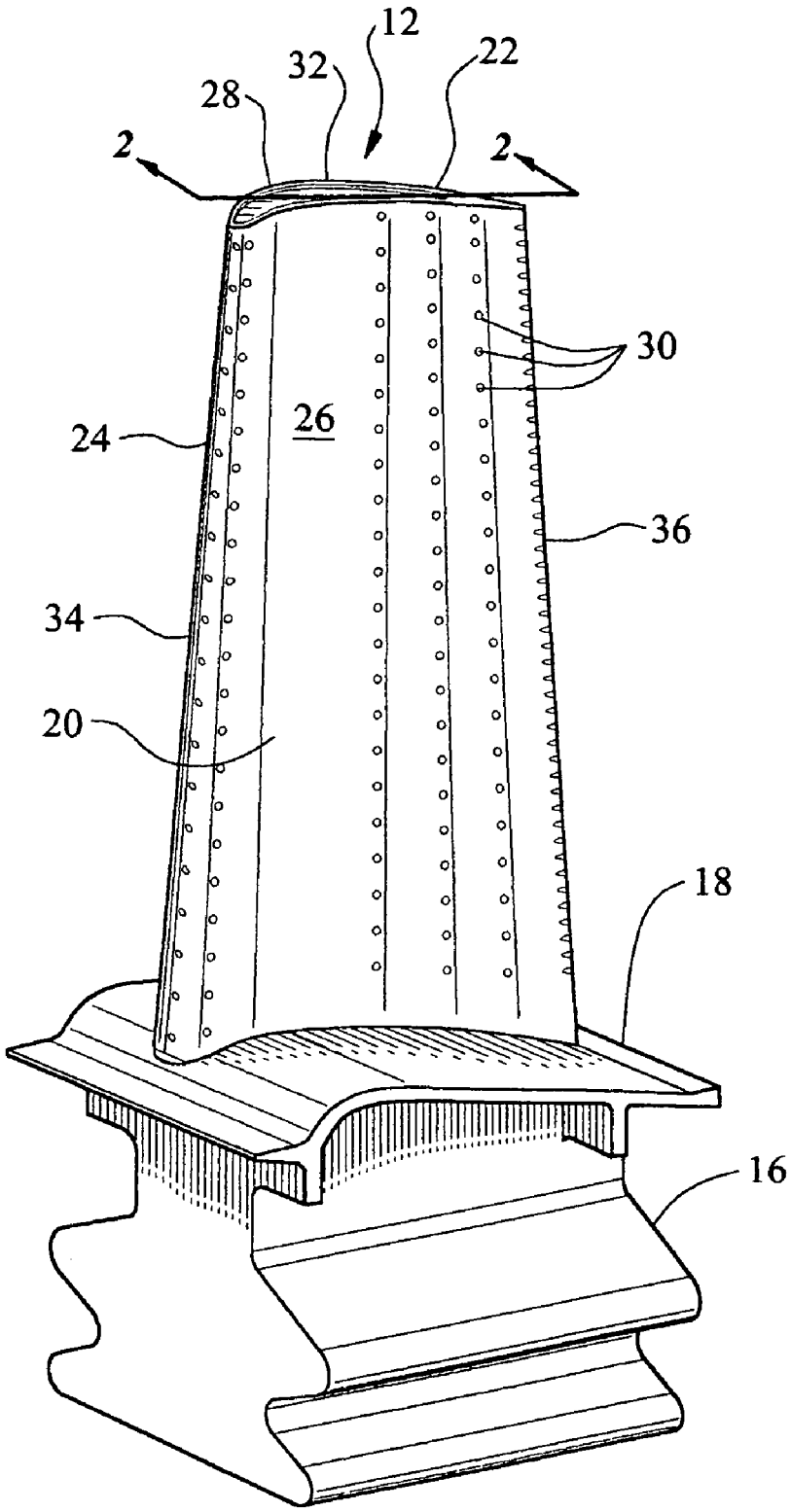
FIG. 1 is a perspective view of a turbine blade having features according to the instant invention.
Figure 2:
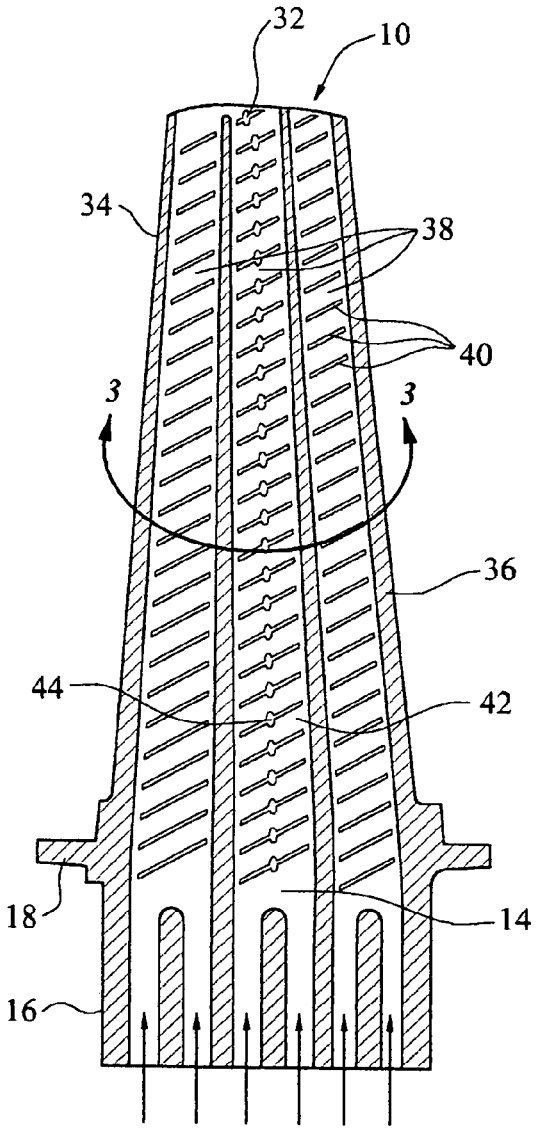
FIG. 2 is cross-sectional view, referred to as a filleted view, of the turbine blade shown in FIG. 1 taken along line 2—2.

As shown in FIGS. 1–7, this invention is directed to a turbine blade cooling system 10 for turbine blades 12 used in turbine engines. In particular, the turbine blade cooling system 10 is directed to a cooling system 10 located in a cavity 14, as shown in FIG. 2, positioned between two or more walls forming a housing 24 of the turbine blade 12. As shown in FIG. 1, the turbine blade 12 may be formed from a generally elongated blade 20 coupled to the root 16 at the platform 18. Blade 20 may have an outer wall 22 adapted for use, for example, in a first stage of an axial flow turbine engine. Outer wall 22 may be formed from a housing 24 having a generally concave shaped portion forming pressure side 26 and may have a generally convex shaped portion forming suction side 28.

The cavity 14, as shown in FIG. 2, may be positioned in inner aspects of the blade 20 for directing one or more gases, which may include air received from a compressor (not shown), through the blade 20 and out one or more orifices 30 in the blade 20 to reduce the temperature of the blade 20. As shown in FIG. 1, the orifices 30 may be positioned in a tip 32, a leading edge 34, or a trailing edge 36, or any combination thereof, and have various configurations. The cavity 14 may be arranged in various configurations, and the cooling system 10 is not limited to a particular flow path.

The cooling system 10, as shown in FIG. 2, may be formed from one or more cooling channels 38 for directing cooling fluids the turbine blade 12 to remove excess heat to prevent premature failure. The cooling channels 38 may include one or a plurality of protrusions 40, otherwise referred to as trip strips or turbulators, as shown in FIG. 2 and more specifically in FIGS. 3 and 5–7. The protrusions 40 may extend out from an inner surface 42 forming the cooling channel 38. During operation, the protrusions 40 disrupt the flow of cooling fluids through the turbine blade 12 and thereby enhance heat transfer in the cooling channels 38.

In at least one embodiment, the protrusions 40 may include a vortex breaker 44 positioned along the protrusion 40 for disrupting the flow of a vortex formed along the length of the protrusion 40. By disrupting the vortex of cooling fluids along the protrusion 40, the amount of heat transfer increases as the vortex created along the protrusion 40 and flowing from one channel wall 46 to another wall 48 is broken. By breaking the vortex, the thickened boundary layer is dissipated and a new boundary layer is formed in a newly formed vortex that forms downstream of the vortex breaker. Thus, the vortices forming downstream of the vortex breaker 44 along the protrusion 40 to which a vortex breaker 44 is attached have a thinner boundary layer than the vortex upstream of the vortex breaker 44 and thereby, have increased heat transfer enhancement relative to the vortex breaker 44 protrusions 40 without vortex breakers 44.

Figure 3:
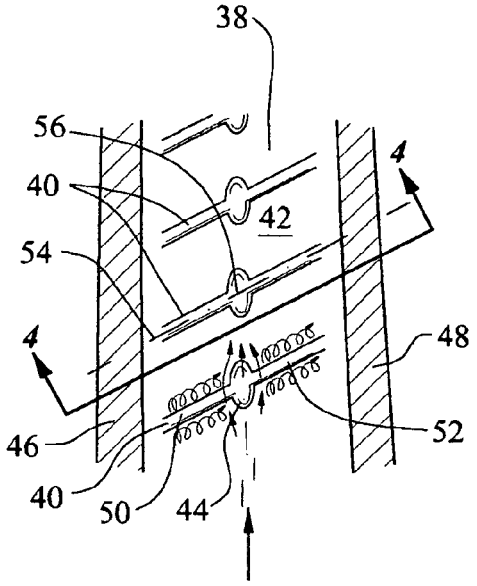
FIG. 3 is a partial cross-sectional view of the turbine blade shown in FIG. 2 taken along line 3—3.
Figure 5:
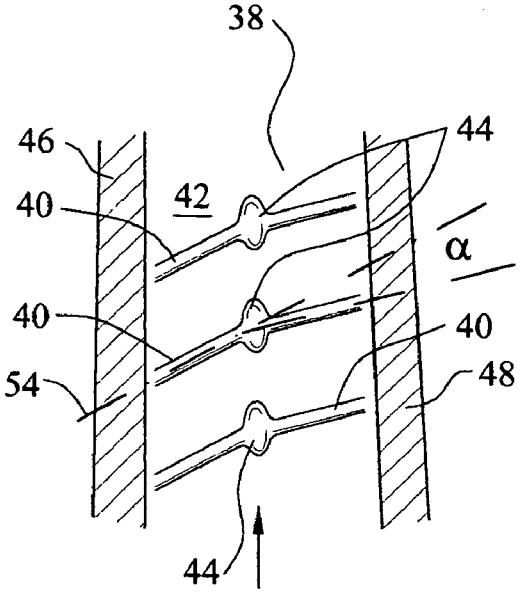
FIG. 5 is a cross-sectional view of an alternative embodiment of the invention.
Figure 6:
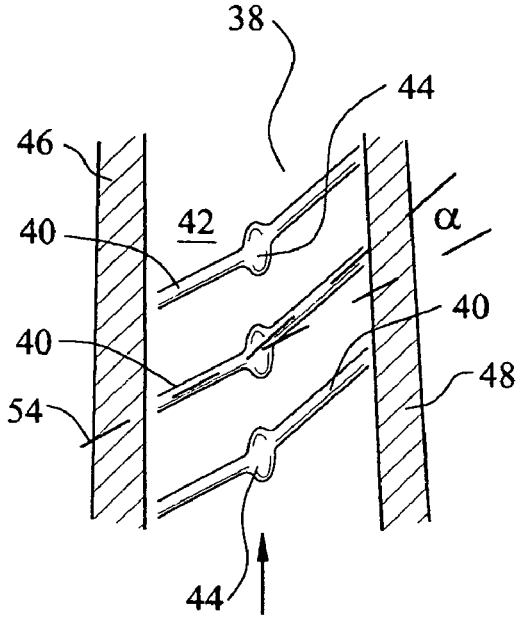
FIG. 6 is a cross-sectional view of another alternative embodiment of the invention.

As shown in FIG. 3, the vortex breaker 44 may divide a protrusion 40 into an upstream section 50 and a downstream section 52. The upstream and downstream sections 50, 52 may extend generally along a longitudinal axis 54. The vortex breaker 44 may be positioned at a midpoint 56 along the protrusion 40. In other embodiments, the vortex breaker 44 may be positioned at other locations along a protrusion 40. In another embodiment, the downstream section 52 may form an angle $\alpha$ between a longitudinal axis 54 by extending in an upstream direction, as shown in FIG. 5, or extending downstream, as shown in FIG. 6. Angle $\alpha$ may be any amount between about five degrees and about 90 degrees. Thus, the downstream section 52 is nonparallel with the upstream section 50.

Figure 4:
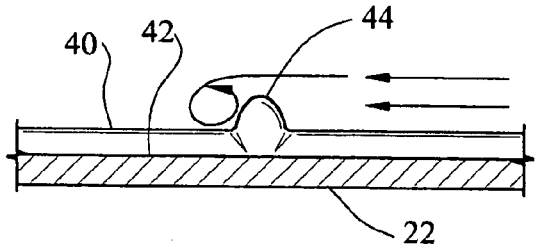
FIG. 4 is a cross-sectional view of the turbine blade shown in FIG. 3 taken along line 4—4.

The vortex breaker 44 may have any shape capable of disrupting the cooling fluid vortex flowing along the protrusion 40. In at least one embodiment, as shown in FIGS. 3–7, the vortex breaker 44 may have a generally oval shape. The vortex breaker 44 may also be sized such that the width of the vortex breaker 44 is greater than a width of the at least one first protrusion 40 and a height of the vortex breaker 44 is greater than a width of the at least one first protrusion 40. In at least one embodiment, the width of the vortex breaker 44 may be about three times the width of the protrusion 40. The vortex breaker 44 may also have a height that is about three times the width of the protrusion 40, as shown in FIG. 4. The height of the cooling channel 38 in which the vortex breaker 44 is positioned may greater than a height of the vortex breaker 44 such that the vortex breaker 44 does not contact the opposing surface forming the cooling channel 38.

Figure 7:
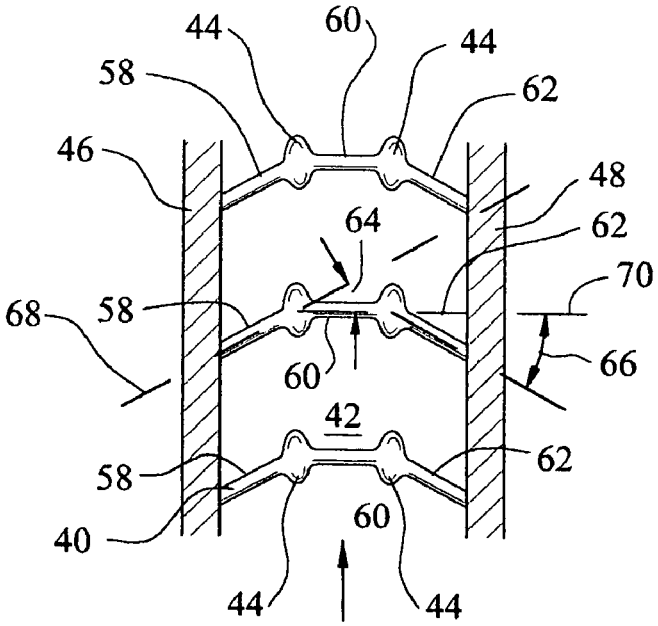
FIG. 7 is a cross-sectional view of still another alternative embodiment of the invention.

In some embodiments, more than one vortex breaker 44 may be included on a single protrusion 40, as shown in FIG. 7. For instance, two vortex breakers 44 may be positioned on a protrusion 40. The vortex breakers 44 may divide a protrusion 40 into an upstream section 58, a midsection 60, and downstream section 62. The embodiment may be configured such that the midsection 60 is positioned relative to the upstream section 58 at a first angle 64, and the downstream section 62 is positioned at a second angle 66. The first angle 64 and second angles 66 may be between about five degrees and about 60 degrees. As shown in FIG. 7, the first angle 64 may extend from a longitudinal axis 68 of the upstream section 58 upstream. Likewise, the second angle 66 may extend from a longitudinal axis 70 of the midsection 60 upstream. First and second angles 64, 66 may or may not have equal values. In at least one embodiment, the downstream section 62 and the upstream section 58 may be substantially mirror images of each other, and the midsection 60 may be substantially orthogonal to the walls forming the cooling channel 38. The midsection 60 may also be positioned generally orthogonal to the flow of cooling fluids through the cooling channels 38.

During operation of the turbine engine, cooling fluids, which are often formed from air, flow through the cooling channels 38 forming the cooling system 10. The cooling fluids increase in temperature, thereby reducing the temperature of the turbine blade through which the cooling fluids flow. As cooling fluids flow through the cooling channel 38 and strike an upstream section 50 of the protrusion 40, the cooling fluid forms a vortex that flows along the downstream side of the protrusion 40, as shown in FIG. 3. The vortex thickens, or grows, as it moves along the protrusion 40 toward the vortex breaker 44. As the vortex grows, the heat transfer enhancement due to the vortex is reduced. The vortex dissipates when the vortex contacts the vortex breaker 44. Cooling fluids passing over the downstream section 52 of the protrusion 40 just downstream of the vortex break 44 create another vortex that moves along the protrusion 40 toward a wall 48 forming the cooling channel 38 where the vortex dissipates, and the cooling fluids forming the vortex flow downstream. By placing the vortex breaker 44 on the protrusion 40, the thickened vortex is dissipated and another vortex having a larger heat transfer enhancement relative to the upstream vortex is formed.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade having a leading edge, a trailing edge, a tip at a first end, a root coupled to the blade at an end generally opposite the first end for supporting the blade and for coupling the blade to a disc, and at least one cavity forming a cooling system in the blade;

at least one first protrusion protruding from a surface of the cooling system in a cooling channel and positioned at an angle greater than zero relative to a general direction of cooling fluid flow through the cooling system; and a vortex breaker positioned on the at least one first protrusion, wherein a width of the vortex breaker is greater than a width of the at least one first protrusion and a height of the vortex breaker is greater than a width of the at least one first protrusion;

wherein a height of the cooling channel in which the vortex breaker is positioned is greater than a height of the vortex breaker.

2. The turbine blade of claim 1, wherein the width of the vortex breaker is about three times the width of the at least one protrusion.

3. The turbine blade of claim 1, wherein the height of the vortex breaker is about three times the height of the at least one protrusion.

4. The turbine blade of claim 1, wherein the vortex breaker is positioned generally at a midpoint of the at least one protrusion.

5. The turbine blade of claim 1, wherein the vortex breaker is substantially oval shaped.

6. The turbine blade of claim 1, wherein the at least one protrusion is formed from a upstream section extending generally upstream from the vortex breaker and a downstream section extending generally downstream from the vortex breaker, wherein a longitudinal axis of the upstream section of the at least one protrusion is nonparallel to a longitudinal axis of the downstream section of the at least one protrusion.

7. The turbine blade of claim 6, wherein the downstream section of the at least one protrusion extends from the vortex breaker at an angle greater than zero relative to the longitudinal axis of the upstream section on an upstream side of the longitudinal axis of the upstream section.

8. The turbine blade of claim 6, wherein the downstream section of the at least one protrusion extends from the vortex breaker at an angle greater than zero relative to the longitudinal axis of the upstream section on a downstream side of the longitudinal axis of the upstream section.

9. The turbine blade of claim 1, wherein the vortex breaker comprises two vortex breakers positioned on the at least one protrusion, and the at least one protrusion is formed by an upstream section, a midsection, and a downstream section.

10. The turbine blade of claim 9, wherein the midsection is at a first angle relative to a longitudinal axis of the upstream section on an upstream side of the longitudinal axis, and the downstream section is at a second angle relative to a longitudinal axis of the midsection on an upstream side of the longitudinal axis of the midsection.

11. The turbine blade of claim 10, wherein the first and second angles are substantially equal.

12. The turbine blade of claim 11, wherein the midsection is substantially orthogonal to the general flow of cooling fluids through the cooling system, and the downstream section extends from the midsection in a generally upstream direction.

13. The turbine blade of claim 1, wherein the at least one first protrusion comprises a plurality of protrusions extending from a surface forming the cooling system, wherein the plurality of protrusions are aligned generally along the direction of cooling fluid flow.

14. A turbine blade, comprising:

a generally elongated blade having a leading edge, a trailing edge, a tip at a first end, a root coupled to the blade at an end generally opposite the first end for supporting the blade and for coupling the blade to a disc, and at least one cavity forming a cooling system in the blade;

at least one first protrusion protruding from a surface of the cooling system in a cooling channel and positioned at an angle greater than zero relative to a general direction of cooling fluid flow through the cooling system; and a vortex breaker positioned generally at a midpoint on the at least one first protrusion and having a generally oval shape, wherein a width of the vortex breaker is greater than a width of the at least one first protrusion and a height of the vortex breaker is greater than a width of the at least one first protrusion;

wherein a height of the cooling channel in which the vortex breaker is positioned is greater than a height of the vortex breaker.

15. The turbine blade of claim 14, wherein the width of the vortex breaker is about three times the width of the at least one protrusion.

16. The turbine blade of claim 14, wherein the height of the vortex breaker is about three times the height of the at least one protrusion.

17. The turbine blade of claim 14, wherein the at least one protrusion is formed from a upstream section extending generally upstream from the vortex breaker and a downstream section extending generally downstream from the vortex breaker, wherein a longitudinal axis of the upstream section of the at least one protrusion is not parallel to a longitudinal axis of the downstream section of the at least one protrusion.

18. The turbine blade of claim 17, wherein the downstream section of the at least one protrusion extends from the vortex breaker at an angle greater than zero relative to the longitudinal axis of the upstream section on an upstream side of the longitudinal axis of the upstream section.

19. The turbine blade of claim 17, wherein the downstream section of the at least one protrusion extends from the vortex breaker at an angle greater than zero relative to the longitudinal axis of the upstream section on a downstream side of the longitudinal axis of the upstream section.

20. A turbine blade, comprising:

a generally elongated blade having a leading edge, a trailing edge, and a tip at a first end, a root coupled to the blade at an end generally opposite the first end for supporting the blade and for coupling the blade to a disc, and at least one cavity forming a cooling system in the blade;

at least one first protrusion protruding from a surface in a cooling channel forming the cooling system and positioned at an angle greater than zero relative to a general direction of cooling fluid flow through the cooling system, wherein a height of the cooling channel in which the vortex breaker is positioned is greater than a height of the vortex breaker; and at least two vortex breakers positioned on the at least one first protrusion and having a generally oval shape, wherein a width of the vortex breaker is greater than a width of the at least one first protrusion and a height of the vortex breaker is greater than a height of the at least one first protrusion;

wherein the at least one first protrusion is formed from an upstream section, a midsection, and a downstream section;

wherein the midsection is at a first angle relative to a longitudinal axis of the upstream section on an upstream side of the longitudinal axis and the downstream section is at a second angle relative to a longitudinal axis of the midsection on an upstream side of the longitudinal axis of the midsection;

wherein the midsection is substantially orthogonal to the general flow of cooling fluids through the cooling system, and the downstream section extends from the midsection in a generally upstream direction.

* * * * *